United States Patent [19]

Lamb et al.

[11] Patent Number: 5,048,186

[45] Date of Patent: Sep. 17, 1991

[54] SHEAR GUARD

[76] Inventors: George L. Lamb; Frances A. Lamb, both of 570 Encina Dr., El Dorado Hills, Calif. 95630

[21] Appl. No.: 670,476

[22] Filed: Mar. 15, 1991

Related U.S. Application Data

[63] Continuation-in-part of Ser. No. 273,900, Nov. 21, 1988, abandoned.

[51] Int. Cl.[5] ..... D26B 13/00

[52] U.S. Cl. ..... 30/233; 63/2; 63/15

[58] Field of Search ..... 2/158, 163; 29/8; 63/2, 63/12, 15; 30/233

[56] References Cited

U.S. PATENT DOCUMENTS

| | | | |
|---|---|---|---|
| 187,144 | 2/1877 | Huss | 30/298 X |
| D. 193,600 | 9/1962 | Kravitz | 63/15 X |
| 471,221 | 3/1892 | Moores | 63/2 X |
| 1,074,864 | 10/1913 | Howell | 30/298 |
| 4,033,143 | 7/1977 | Michael | 63/2 |

*Primary Examiner*—Douglas D. Watts
*Attorney, Agent, or Firm*—Joseph E. Gerber

[57] ABSTRACT

A guard for protecting a finger from the blades of a pair of shears is disclosed, and includes a band of rigid yet formable planar material disposed in a ring-like configuration. The band has opposed wide and narrow ends with a gap therebetween adjustable to comfort around said finger. The band further includes a front edge oriented transverse to the finger's axis and generally perpendicular to the band's wide and narrow ends, and a rear edge angled between the wide and narrow ends so as to permit the wide end to protect the knuckle where the finger joins the hand, and so as to permit the narrow end to cover the fleshy pad beneath the finger.

9 Claims, 5 Drawing Sheets

SHEAR GUARD

This is a continuation-in-part of Ser. No. 07/273,900 filed Nov. 21, 1988, now abandoned.

BACKGROUND OF THE INVENTION

1. Field of the Invention

The present invention relates generally to finger rings, and more specifically to rings for protecting the fingers.

2. Description of the Related Art

Those who cut hair professionally work with extremely sharp scissors. Modern hair cutting techniques require such professionals to grasp sections of hair between the outer ends of two extended fingers and to cut along the fingers using them as a guide. However, the first knuckle of each finger, i.e. where the finger attaches to the hand, is prominent and particularly susceptible to being razed or caught between the scissors' blades. Although the commonly-quoted rule of safe technique is to "avoid cutting beyond the second knuckle," haste and the occasional need to make a difficult cutting maneuver sometimes prompt the breach of this rule. Indeed, if one is able to cut a larger section of hair in a single pass, a haircut may be completed more quickly, thereby increasing productivity.

Another area vulnerable to injury is the fleshy pad on the finger's underside; it tends to protrude and is therefore exposed to being cut when using the underside of the fingers as a guide.

Thus, some manner of protecting the first knuckle is needed, both to guard against the occasional slip of the scissors and to permit extension of the standard cutting range beyond that knuckle. Further, any device directed to this purpose should protect the pad on the finger's underside without inhibiting the finger's ability to flex where it joins the hand.

Rings of various configurations are in common use for adornment of the human hand. However, a device directed to the above purposes goes beyond, in structure, the styles commonly employed for mere adornment.

SUMMARY OF THE INVENTION

The shear guard of the present invention is adapted to address the above-stated needs. It comprises a rigid, yet formable, generally cylindrical, ring-like band that when laid flat is oblong and very roughly quadrangular. A first, wider end edge of this band is roughly twice the width of a second, narrower, opposing end edge. And, these end edges are approximately parallel to one another.

One of the two longer side edges of the band is its front edge which is oriented roughly perpendicular to the end edges. That is, it meets each end edge at roughly a right angle. The edge opposite the front edge is the rear edge of the band, and this also runs between the end edges. However, the rear edge is longer than the front edge and nonparallel thereto, meeting the wider end edge at an acute angle.

When bent into a generally cylindrical shape and seated on a finger with its front edge distal to the hand, and when rotated to place the band's wider end over the finger's upper surface, this wider end projects up to and protects that knuckle where the finger meets the hand. This causes scissor blades, and the like, to be deflected away from this first knuckle as they are directed along a line approximately parallel to the finger. At the same time, the narrower end wraps beneath and protects the finger's fleshy pad, leaving the knuckle's underside free to flex.

Thus, it is an object of the present invention to provide protection from the blades of shears to the upper surface of a finger and to the finger's first knuckle.

It is a further object of the present invention to provide protection to the fleshy pad on the finger's underside.

Yet another object of this invention is to provide a device that is adjustable for comfort around the finger, as well as being adapted to protecting the finger and its knuckle from the blades of a pair of shears.

Still further objects of the inventive shear guard disclosed herein will be apparent from the drawings and following detailed description thereof.

DESCRIPTION OF THE PREFERRED EMBODIMENTS

Figure 1:
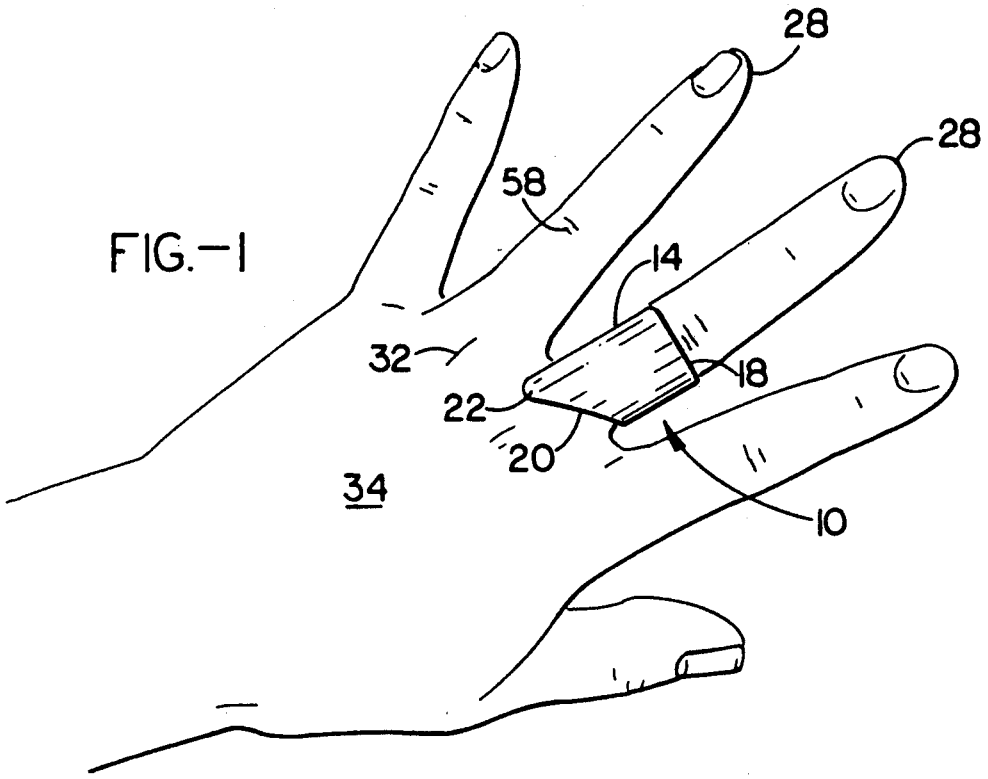
FIG. 1 shows one embodiment of the shear guard of the present invention seated at the base of a finger on a wearer's hand as the shear guard appears from the back of the hand.
Figure 2:
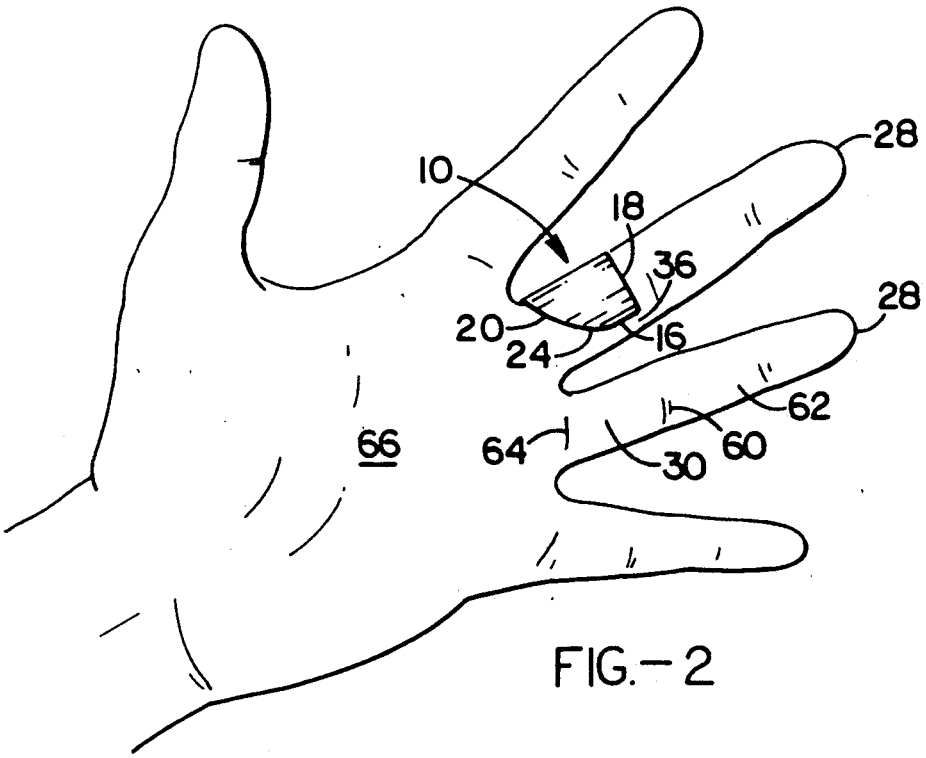
FIG. 2 is a view of the shear guard and hand of FIG. 1 as they appear from the palm side of the hand.
Figure 3:
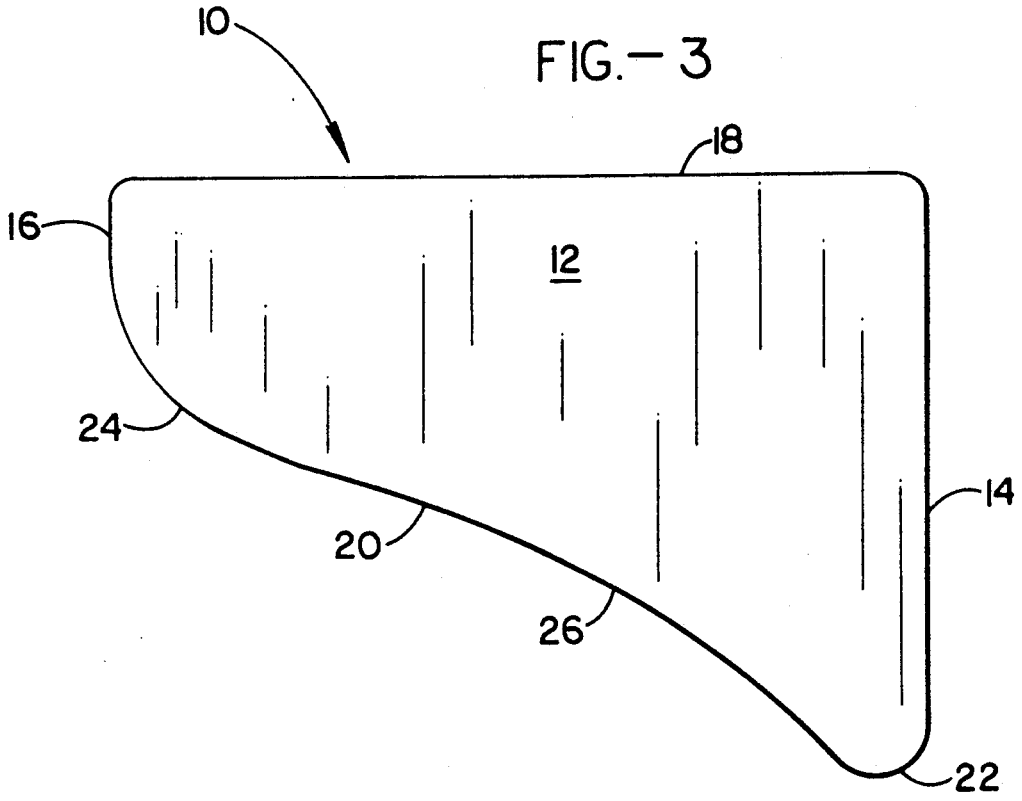
FIG. 3 is a plan view of the shear guard shown in FIGS. 1 and 2 laid flat to best illustrate the shape of its perimeter.

Referring now specifically to the drawings, FIGS. 1, 2 and 3 show a first embodiment of the shear guard of the present invention, generally designated therein by reference numeral 10. Shear guard 10 is comprised of an oblong band 12 curled into a generally cylindrical, ring-like configuration. When laid flat, band 12 is revealed to be comprised of a planar piece of stock shaped substantially as shown in FIG. 3. This stock is preferably a rigid, yet formable material. Aluminum of approximate thicknesses from 0.030 to 0.060 inches has been used for this purpose with success. And, brass has also been found to work well. Other planar, rigid, formable materials may also suffice.

With continuing reference to FIG. 3, band 12 is shown to be somewhat oblong and generally quadrangular, including a wider end 14 edge and a narrower end edge 16. Wider end edge 14 is generally straight and preferably roughly twice the width of narrower end edge 16.

A front edge 18 is oriented perpendicular to wider end edge 14; i.e., front edge 18 meets edge 14 a right angle. Narrower end edge 16 meets front edge 18 at a right angle, but curves toward, and blends with, rear edge 20.

Rear edge 20 opposes front edge 18 and closes band 12's generally quadrangular shape. Edge 20 is necessarily longer than front edge 18 as it runs at an angle thereto, and is bound on its ends where it meets end edges 14 and 16.

A rounded acute angle 22 is described where rear edge 20 meets wider end edge 14. And rounded angle 24, where rear edge 20 meets narrower end edge 16, is obtuse.

Rear edge 20 also includes a slight inward curve 26 between its midpoint and wider end edge 14.

All angles of the shear guard preferably have rounded shapes. This feature prevents discomfort, injury and damage in its use.

In use, shear guard 10 is donned by slipping it over a finger 28 and seating it at the finger's base as shown in FIGS. 1 and 2. Proper placement includes orientation of front edge 18 distal to the hand, with wider edge 14 covering the upper surface of the finger, and with narrower edge 16 to the finger's underside, substantially covering its first fleshy pad 30. (Anatomical structures are labeled on an adjacent finger.) This orientation permits proximally-protruding angle 22 to protect the first knuckle 32, the first knuckle being where finger 28 meets back of hand 34. The gap 36 between end edges 14 and 16 may be adjusted for comfort to accommodate the girth of the finger.

Figure 7:
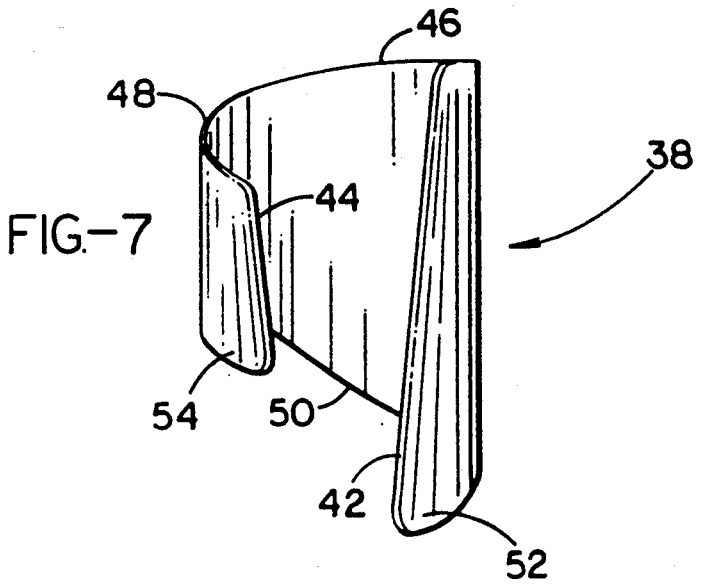
FIG. 7 is a front elevation of the shear guard of FIG. 4.

A second, more preferred, embodiment of the shear guard of the present invention is disclosed in FIGS. 4, 5, 6, 7 and 8, and is generally designated therein by reference numeral 38. Shear guard 38 may be constructed of the same materials as shear guard 10. Shear guard 38 is comprised of an oblong band 40 curled into a generally cylindrical, ring-like configuration. However, as shown in FIG. 7, a slightly conical shape is preferred in shear guard 38, that end of the guard adapted to rest proximal to the hand being somewhat smaller in circumference than that end adapted to rest distal thereto. When laid flat, as in FIG. 6, band 40 is revealed to be comprised of a planar piece of stock.

Figure 6:
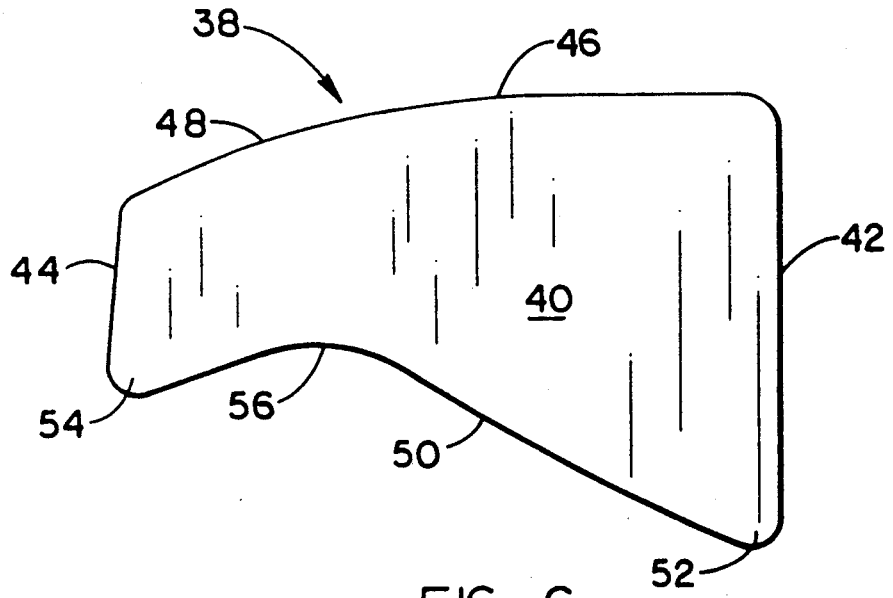
FIG. 6 is a plan view of the shear guard of FIG. 4 laid flat to best illustrate the shape of its perimeter.
Figure 8:
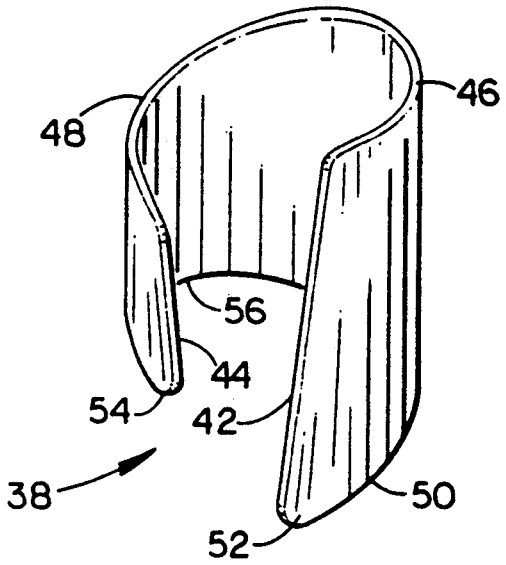
FIG. 8 is a perspective view of the shear guard of FIG. 4.

With continuing reference to FIG. 6, band 40 is shown to be somewhat oblong and generally quadrangular, including a wider end edge 42 and a narrower end edge 44. Wider end edge 42 is preferably roughly twice the width of narrower end edge 44. And, with reference to FIG. 7, when curled into a ring shape, the preferred conical configuration causes wider and narrower end edges 42 and 44 to be nonparallel to one-another.

A front edge 46 is oriented roughly perpendicular to end edges 42 and 44. Front edge 46 meets edges 42 and 44 at, roughly, right angles. Front edge 46 may also include a slight arc 48 rearward toward its narrower end edge 44 as shown in FIG. 6. And, when curled into a ring, arc 48, along with this embodiment's preferred conical shape causes that part of front edge 46 closest to narrower end edge 44 to be noticeably more proximal to the hand than that part of front edge 46 closest to wider end edge 42. That is, shear guard 38's front edge 46 will be more distal to the hand on the upper surface of the finger than it will be on the undersurface of the finger. The purpose of this arc is added comfort, as discussed below.

Referring again to FIG. 6, rear edge 50 opposes front edge 46 and closes band 40's quadrangular shape. Edge 50 is necessarily longer than front edge 46 as it runs at an angle thereto, and is bound on its ends where it meets end edges 42 and 44. An acute angle 52 is described where rear edge 50 meets wider end edge 42. Angle 54, where rear edge 50 meets narrower end edge 44, is also acute. Thus, a cove 56 is described in rear edge 50 where the legs of acute angles 52 and 54 meet. Cove 56 improves comfort, although satisfactory function may nevertheless be expected without it as in the first described embodiment of the shear guard 10.

These differences in the more preferred shear guard, 38 over the first embodiment of shear guard 10, are included to increase comfort in use. The slight arc 48 in front edge 46, toward narrower end 44 of guard 38, permits that edge to be substantially transverse to the axis of finger 28 on the finger's upper surface, with wide end edge 42 covering the full span of the finger's upper surface between the first and second knuckle (32 and 58, respectively). However, comfort is maximized when the crease 60 between the finger's first and second fleshy pads (30 and 62, respectively) is freer to flex. The slight arc 48 included in front edge 46 permits such flexure with comfort. Cove 56 yields further freedom of finger movement. It permits first knuckle 32 to be protected by proximally-protruding angle 52 while crease 64 between fleshy pad 30 and the hand's palm 66 is free to flex.

Figure 11:
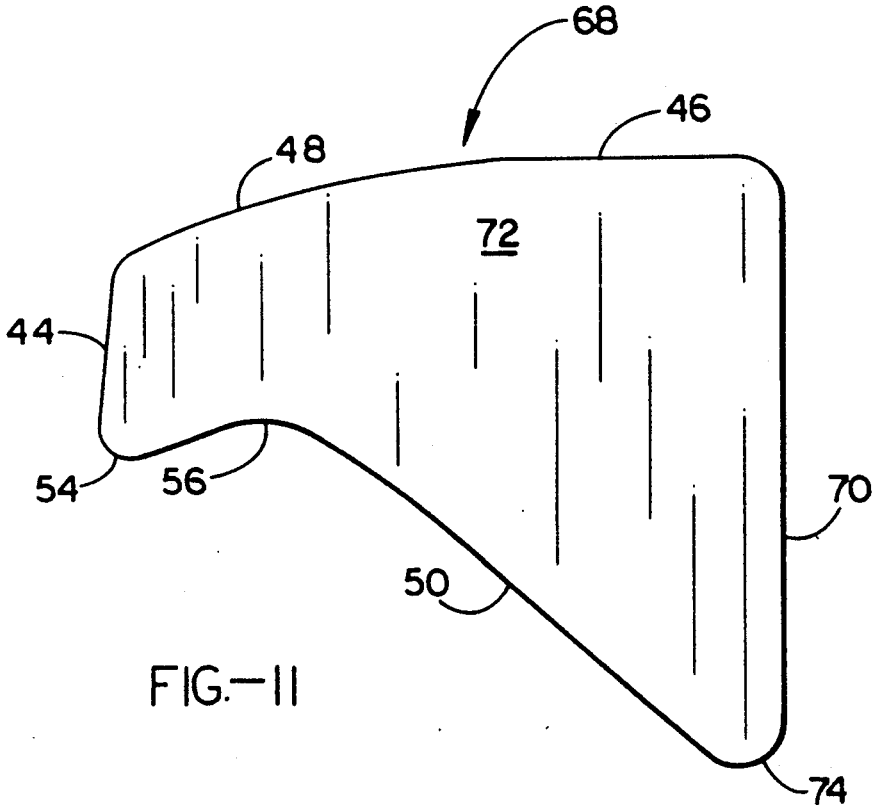
FIG. 11 is a plan view of the shear guard of FIG. 9 laid flat to best illustrate the shape of its perimeter.
Figure 5:
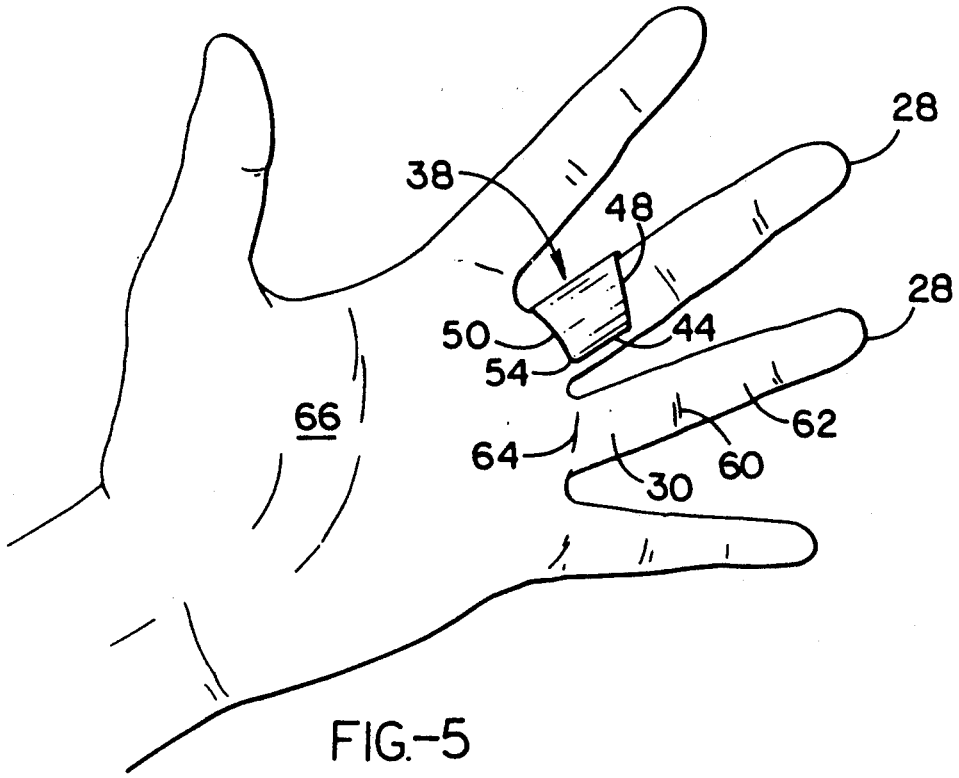
FIG. 5 shows the shear guard of FIG. 4 seated at the base of a finger on a wearer's hand as the shear guard appears from the palm of the hand.
Figure 4:
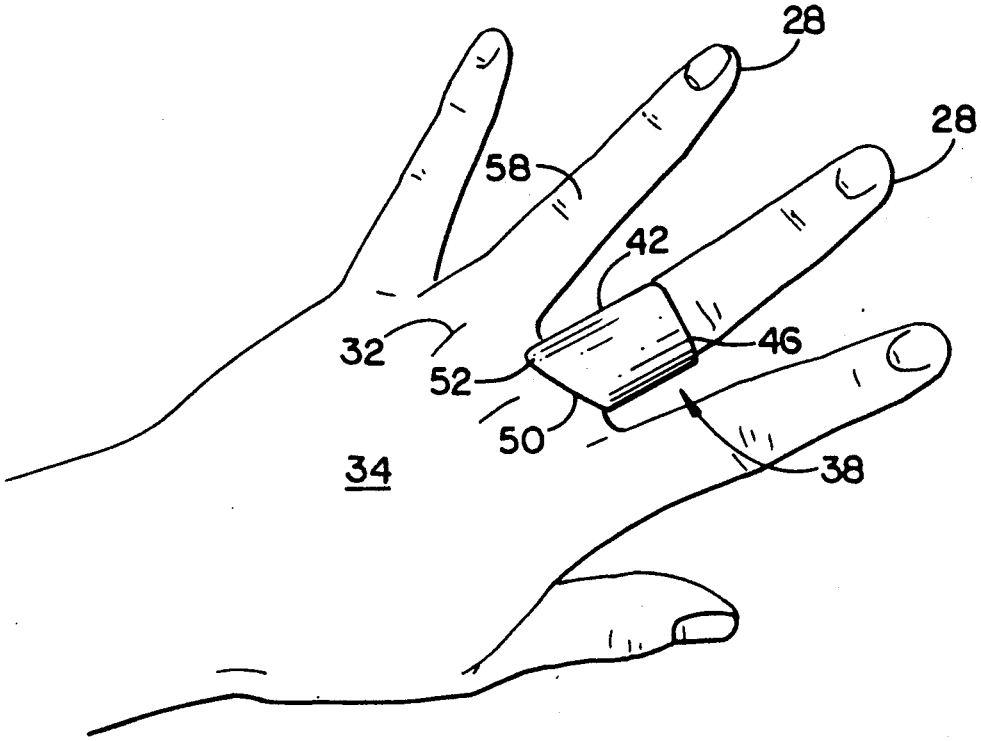
FIG. 4 shows a more preferred embodiment of the shear guard of the present invention seated at the base of a finger on a wearer's hand, as the shear guard appears from the back side of the hand.
Figure 9:
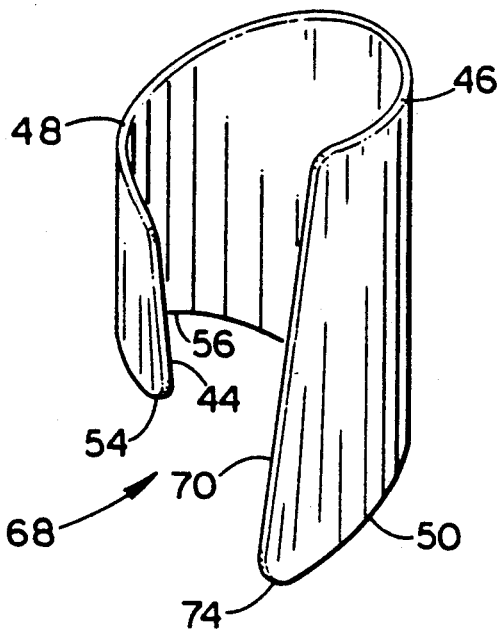
FIG. 9 is a perspective view of a further alternative embodiment of the shear guard of the present invention, said embodiment being adapted to protecting the upper surface of a finger of a wearer having longer fingers.
Figure 10:
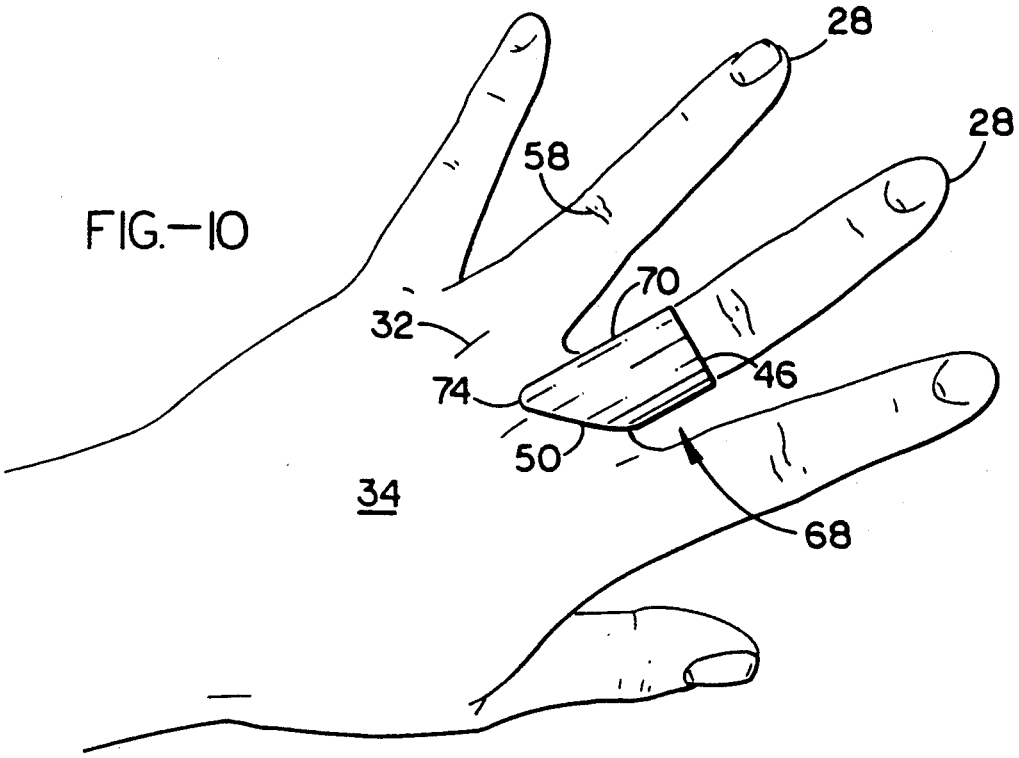
FIG. 10 shows the shear guard of FIG. 9 seated at the base of a finger on a wearer's hand, as the shear guard appears from the back side of the hand.

It is also contemplated that wearers having larger hands and longer fingers may need a slightly altered embodiment of this inventive shear guard. Thus, a third embodiment identified herein with reference numeral 68 is disclosed in FIGS. 9, 10 and 11. As can be seen, shear guard 68 has a wider end edge 70 that is wider than the same edge of alternative shear guard embodiments 10 and 38. As can be seen in the plan view of FIG. 11 where shear guard 68 is laid out as a flat band 72, except for a more acute angle 74 resulting from wider end edge 70, the rest of this embodiment's features closely match those of shear guard 38.

The foregoing detailed disclosure of alternative embodiments of inventive shear guards 10, 38 and 68 is considered as only illustrative of the preferred embodiments of, and not a limitation upon the scope of, the invention. Those skilled in the art will envision many other possible variations of the structure disclosed herein that nevertheless fall within the scope of the following claims. And, many alternative uses for this inventive device are likely to be later be realized. Accordingly, the scope of the invention should be determined with reference to the appended claims, and not by the examples which have herein been given.

We claim:

1. A guard for protecting a finger from the blades of a pair of shears, said guard comprising a band of rigid yet formable planar material disposed in a ring-like configuration, said band having opposed wide and narrow ends with a gap therebetween adjustable to comfort around said finger, said band further including a front edge oriented transverse to said finger's axis and generally perpendicular to said wide and narrow ends, and a rear edge angled between said wide and narrow ends so as to permit said wide end to protect a knuckle of a finger where it joins a hand, and so as to permit said narrow end to cover a fleshy pad beneath said finger.

2. The guard of claim 1, wherein said narrow end is sufficiently narrow to permit said finger to flex at its crease between its first fleshy pad and said hand's palm, and at its crease between its first and second fleshy pads.

3. A guard for protecting a finger from the blades of a pair of shears, said guard comprising a rigid yet formable ring-like band that when laid flat is oblong and roughly quadrangular, a first, wider end edge of said band being roughly twice the width of a second, narrower, opposing end edge thereof and roughly parallel thereto, a front edge of said band being oriented roughly perpendicular to said end edges and meeting same at roughly right angles, and a rear edge of said band also connecting said end edges and being longer than said front edge and nonparallel thereto, meeting said wider end edge at an acute angle, whereby, when seated on a finger with said front edge distal to its hand and when rotated to place said band's wider end over said finger's upper surface, said wider end protects that knuckle where said finger meets said hand, and said narrower end wraps beneath said finger's pad, leaving said knuckle's underside free to flex.

4. The guard of claim 3, wherein said front edge includes a slight rearward arc toward said narrower end edge.

5. The guard of claim 3, wherein said rear edge meets said narrow end edge at an obtuse angle.

6. The guard of claim 3, wherein said rear edge includes a slight inward curve 26 between its midpoint and said wider end edge.

7. The guard of claim 3, wherein said rear edge meets said narrow end edge at an acute angle.

8. The guard of claim 3, wherein said rear edge includes a cove.

9. The guard of claim 3, wherein said band has a slightly conical shape.

* * * * *